US008739854B2

(12) United States Patent
Mullet et al.

(10) Patent No.: US 8,739,854 B2
(45) Date of Patent: Jun. 3, 2014

(54) PRE-ASSEMBLED AND PRE-TENSIONED SHADE WITH INDEXING GEAR TENSIONER

(75) Inventors: Willis J. Mullet, Gulf Breeze, FL (US); Harry E. Asbury, Holt, FL (US)

(73) Assignee: Qmotion Incorporated, Pensacola, FL (US)

( * ) Notice: Subject to any disclaimer, the term of this patent is extended or adjusted under 35 U.S.C. 154(b) by 0 days.

(21) Appl. No.: 13/539,736

(22) Filed: Jul. 2, 2012

(65) Prior Publication Data

US 2014/0000819 A1 Jan. 2, 2014

(51) Int. Cl.
*E06B 9/56* (2006.01)

(52) U.S. Cl.
USPC ..... 160/293.1; 160/323.1; 160/190; 160/309; 160/296

(58) Field of Classification Search
USPC ..... 160/305, 310, 238, 291, 293.1, 294, 160/296, 299, 301, 309, 313, 315, 323.1, 9, 160/188, 189, 190, 191, 192
See application file for complete search history.

(56) References Cited

U.S. PATENT DOCUMENTS

| | | | | |
|---|---|---|---|---|
| 2,060,676 | A | 5/1935 | Kuyper | 156/36 |
| 4,047,441 | A * | 9/1977 | Kellogg | 74/52 |
| 4,294,313 | A * | 10/1981 | Schwegman | 166/117.5 |
| 4,768,733 | A * | 9/1988 | Willey | 242/383 |
| 4,911,381 | A * | 3/1990 | Cannon et al. | 244/122 R |
| 5,769,345 | A * | 6/1998 | Morner et al. | 242/375.3 |
| 5,794,876 | A * | 8/1998 | Morizane et al. | 242/374 |
| 5,964,427 | A * | 10/1999 | Aiston | 242/372 |
| 6,318,662 | B1 * | 11/2001 | Hori et al. | 242/374 |
| 6,419,176 | B1 * | 7/2002 | Mizuno | 242/374 |
| 6,712,116 | B2 * | 3/2004 | Beaudoin et al. | 160/188 |
| 6,959,748 | B2 * | 11/2005 | Hudoba | 160/31 |
| 7,066,699 | B2 * | 6/2006 | Gosling | 411/14.5 |
| 7,296,607 | B2 * | 11/2007 | Krupke et al. | 160/191 |
| 7,533,842 | B2 * | 5/2009 | Saito et al. | 242/390.9 |
| 7,562,840 | B2 * | 7/2009 | Takamatsu et al. | 242/383.1 |
| 7,607,263 | B2 * | 10/2009 | Mullet et al. | 49/200 |
| 7,686,061 | B2 * | 3/2010 | Mullet et al. | 160/191 |
| 7,883,045 | B2 * | 2/2011 | Yamada | 242/383.4 |
| 7,934,673 | B2 * | 5/2011 | Saito et al. | 242/374 |
| 8,136,569 | B2 * | 3/2012 | Bohlen et al. | 160/323.1 |
| 8,186,413 | B2 * | 5/2012 | Fujita et al. | 160/121.1 |
| 8,210,460 | B2 * | 7/2012 | Scherzinger et al. | 242/390.8 |
| 8,299,734 | B2 * | 10/2012 | Mullet et al. | 318/255 |
| 8,368,328 | B2 * | 2/2013 | Mullet et al. | 318/255 |
| 8,371,358 | B1 * | 2/2013 | Mullet et al. | 160/310 |
| 2005/0189080 | A1 * | 9/2005 | Mullet et al. | 160/201 |

(Continued)

OTHER PUBLICATIONS

International Search Report for corresponding application PCT/US2013/046451 mailed Nov. 27, 2013.

(Continued)

*Primary Examiner* — Katherine Mitchell
*Assistant Examiner* — Johnnie A Shablack
(74) *Attorney, Agent, or Firm* — Renner Kenner Greive Bobak Taylor & Weber

(57) ABSTRACT

A movable assembly having a counterbalance gear tensioner includes a covering, a rotatable storage roll with a hollow interior that carries the covering, and a counterbalance assembly that is received in the hollow interior to assist in movement of the covering. A gear tensioner is also received in the hollow interior, rotates with the rotatable storage roll, and is coupled to the counterbalance assembly to adjust a tension force of the counterbalance assembly.

9 Claims, 10 Drawing Sheets

(56) References Cited

U.S. PATENT DOCUMENTS

| | | | | |
|---|---|---|---|---|
| 2006/0232234 | A1* | 10/2006 | Newman | 318/280 |
| 2007/0284053 | A1* | 12/2007 | Mullet et al. | 160/31 |
| 2008/0067278 | A1* | 3/2008 | Fortunato et al. | 242/407 |
| 2008/0121353 | A1* | 5/2008 | Detmer et al. | 160/266 |
| 2008/0191083 | A1* | 8/2008 | Sumiyashiki | 242/382.2 |
| 2008/0210802 | A1* | 9/2008 | Sumiyashiki | 242/379.1 |
| 2010/0269988 | A1* | 10/2010 | Mullet et al. | 160/310 |
| 2010/0308149 | A1* | 12/2010 | Allington et al. | 242/379 |
| 2011/0101145 | A1* | 5/2011 | Maemura et al. | 242/390.8 |
| 2011/0203754 | A1* | 8/2011 | Mullet et al. | 160/405 |
| 2011/0272106 | A1* | 11/2011 | Mullet et al. | 160/311 |
| 2012/0024485 | A1* | 2/2012 | Mullet et al. | 160/313 |
| 2012/0031571 | A1* | 2/2012 | Mullet et al. | 160/310 |
| 2013/0099714 | A1* | 4/2013 | Mullet et al. | 318/468 |
| 2013/0105095 | A1* | 5/2013 | Anderson et al. | 160/310 |

OTHER PUBLICATIONS

Written Opinion for corresponding application PCT/US2013/046451 mailed Nov. 27, 2013.

* cited by examiner

PRE-ASSEMBLED AND PRE-TENSIONED SHADE WITH INDEXING GEAR TENSIONER

TECHNICAL FIELD

The present invention is generally directed to shade assemblies. In particular, the present invention is directed to a tensioning device used with shade assemblies. Specifically, the present invention is directed to a tensioning device wherein the tension is set in a factory or at installation of the shade assembly.

BACKGROUND ART

Shade or blind assemblies used with windows or similar openings are well known. The assemblies provide for privacy when desired and block sunlight or allow sunlight to enter a room. Many types of shades are configured with vertical or horizontal slats that are raised and lowered, or moved sideways, by a chord wherein the angular position adjustment of the slats can also be provided. Both adjustments can be automated or manually implemented.

In some shade assemblies it is desired to provide motorized operation of the shade. This allows for convenient and automated control of the shade assembly. In other words, the shade assemblies can be programmed to open and close at particular times of day or evening so as to let in sunlight when desired or block sunlight when heat in the room becomes uncomfortable. In any event, to assist in operation of the shade assembly, the internal mechanism for raising and lowering of the shade may incorporate a counterbalance assembly. The counterbalance assembly, which usually includes a spring, is utilized to compensate for the weight of the shade and reduces strain on the motor, if provided. The counterbalance spring may be pre-tensioned so as to prevent excessive current draw by the motor which drains the battery more quickly and causes the motor to wear prematurely.

In order to provide for tensioning in prior art shade assemblies it is common to hold the tension and stored potential energy with shear pins as a means to trigger a release event when thresholds are met. These thresholds may be used for safety purposes or to prevent the transmission of undesired forces, but they do not allow further tension adjustments of the counterbalance spring, which many times is needed to achieve optimum counterbalancing. Indeed, it is well known in the prior art to provide counterbalancing systems, but none provide for pre-tensioning of the counterbalance system.

Therefore, there is a need in the art to provide a gear tensioner and related method of installation to store tension in a shade or blind assembly such that the assembly is pre-tensioned at the factory, the point of shade or blind assembly, or during installation of the shade or blind. Further, because a torque profile of counterbalance springs does not always precisely match the force requirement of the roll shade being payed out or reeled on to a storage roll, there is a need to be able to set various pre-tension values on the counterbalance springs. Moreover, there is a need to minimize drag on a motor utilized to raise and lower the shade assembly, thereby extending battery life.

SUMMARY OF THE INVENTION

In light of the foregoing, it is a first aspect of the present invention to provide a pre-assembled and pre-tensioned shade with indexing gear tensioner.

It is another aspect of the present invention to provide a movable assembly having a counterbalance gear tensioner, comprising a covering, a rotatable storage roll that carries the covering, the storage roll having a hollow interior, a counterbalance assembly received in the hollow interior, wherein the counterbalance assembly assists in movement of the covering, and a gear tensioner received in the hollow interior and rotatable with the rotatable storage roll, and coupled to the counterbalance assembly, the gear tensioner adjusting a tension force of the counterbalance assembly.

BRIEF DESCRIPTION OF THE DRAWINGS

This and other features and advantages of the present invention will become better understood with regard to the following description, appended claims, and accompanying drawings wherein:

BEST MODE FOR CARRYING OUT THE INVENTION

Figure 1:
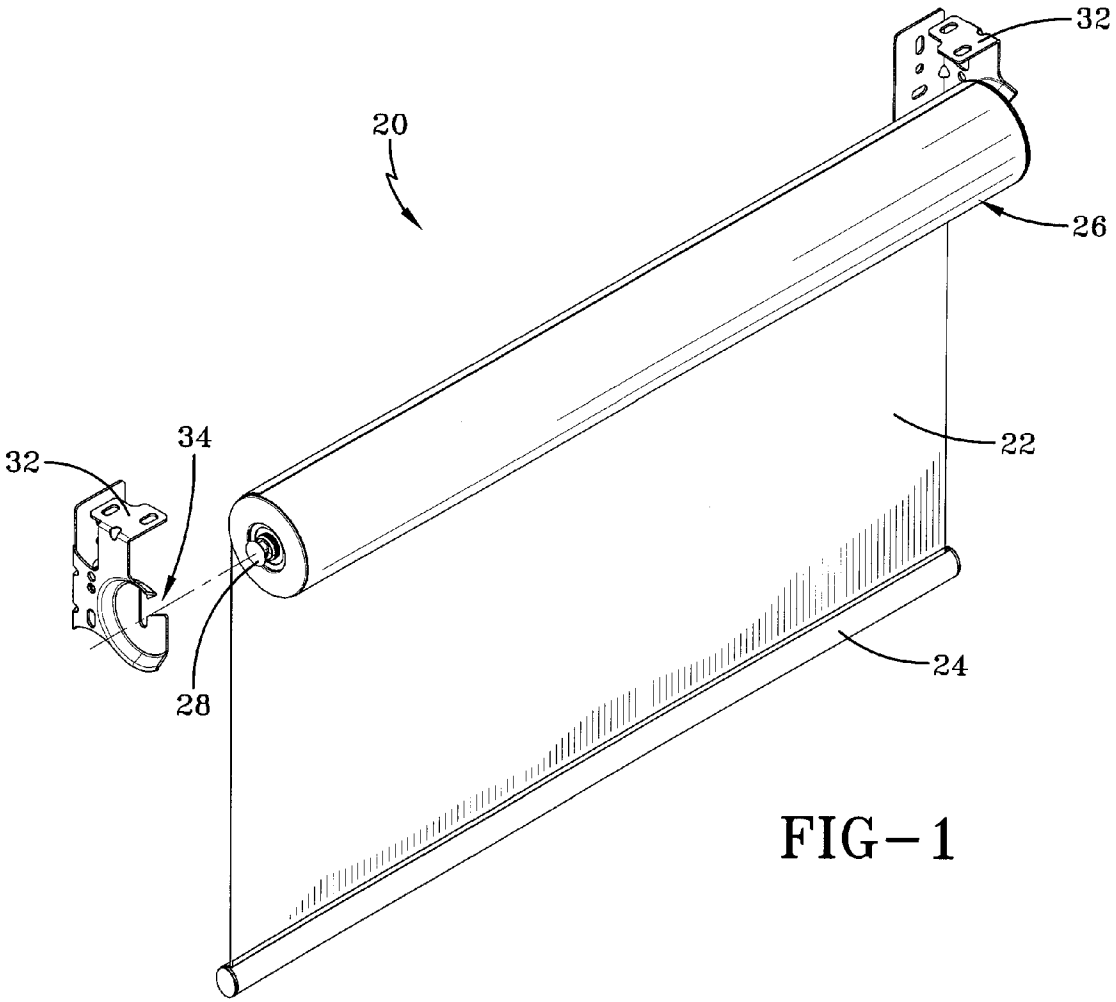
FIG. 1 is a perspective view of a roller shade assembly made in accordance with the concepts of the present invention.
Figure 2:
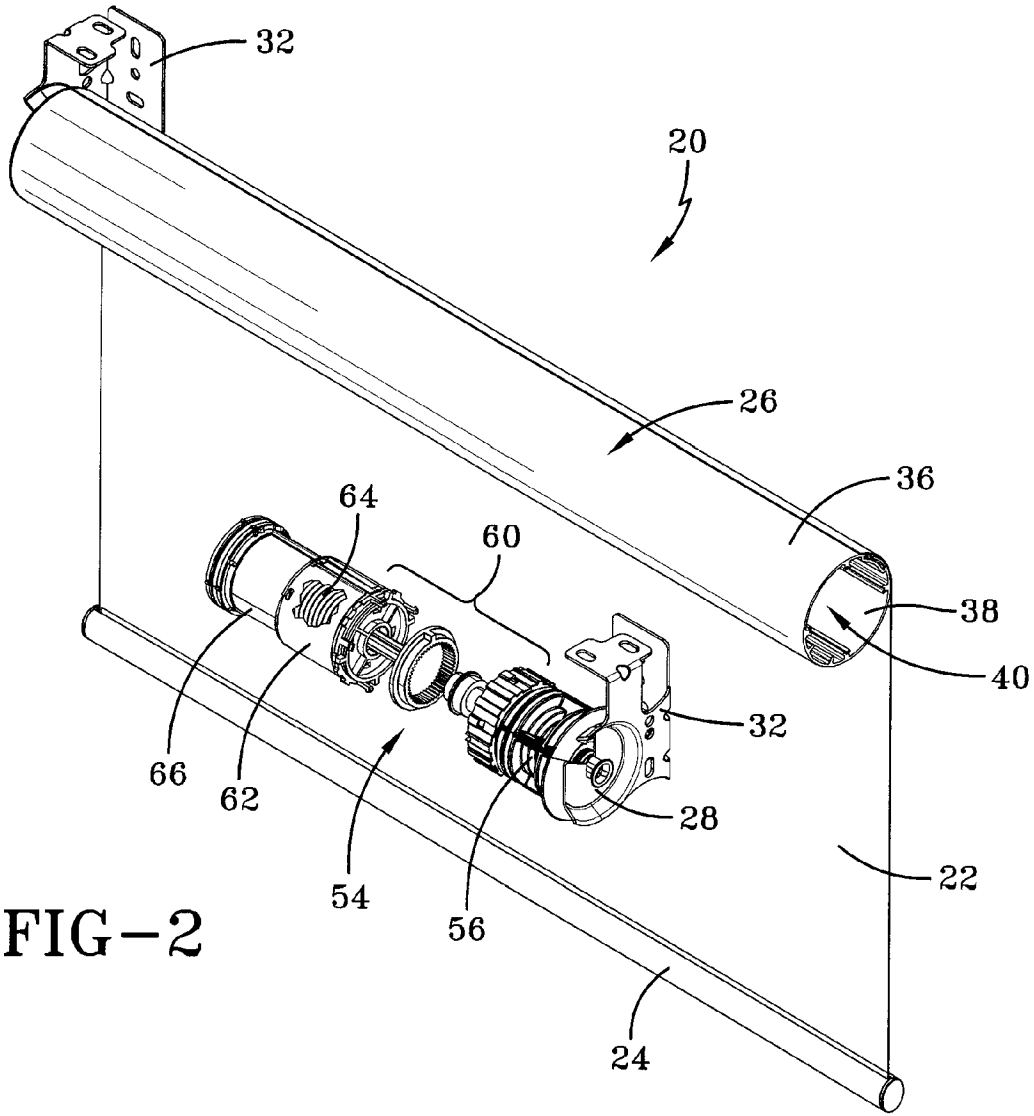
FIG. 2 is a perspective view showing a shade drive assembly maintained within the roller shade assembly according to the concepts of the present invention.

Referring now to the drawings and in particular to FIGS. 1 and 2, it can be seen that a roller shade assembly according to the concepts of the present invention is designated generally by the numeral 20. The assembly 20 includes a covering 22 which could be a shade or a blind or any other covering of a window or similar opening. Skilled artisans will appreciate that the roller shade assembly is typically installed on the interior side of a window or opening, but in some instances the assembly may be installed on the exterior side. Attached to the covering 22 is a bottom bar 24 which is disposed at a distal end of the covering wherein the other end of the covering is attached to a storage roll 26. The storage roll is typically of a tubular construction so as to hold internal components as will be discussed. As is well understood in the art, the covering 22 wraps around the storage roll 26 when in an open or upward position and unwraps or unreels from the storage roll when moved to a closed or lowered position. Extending axially from the storage roll 26 are a pair of opposed support shafts 28. A bearing housing 56 is radially disposed between the support shaft and the interior surface of the storage roll 26. A support bracket 32 is mounted to the structure surrounding the opening or window with fasteners or the like. Each bracket 32 provides a bracket slot 34 which rotatably receives the support shafts 28. As such, the storage roll 26 is allowed to freely rotate between the bracket slots 34.

Figure 3:
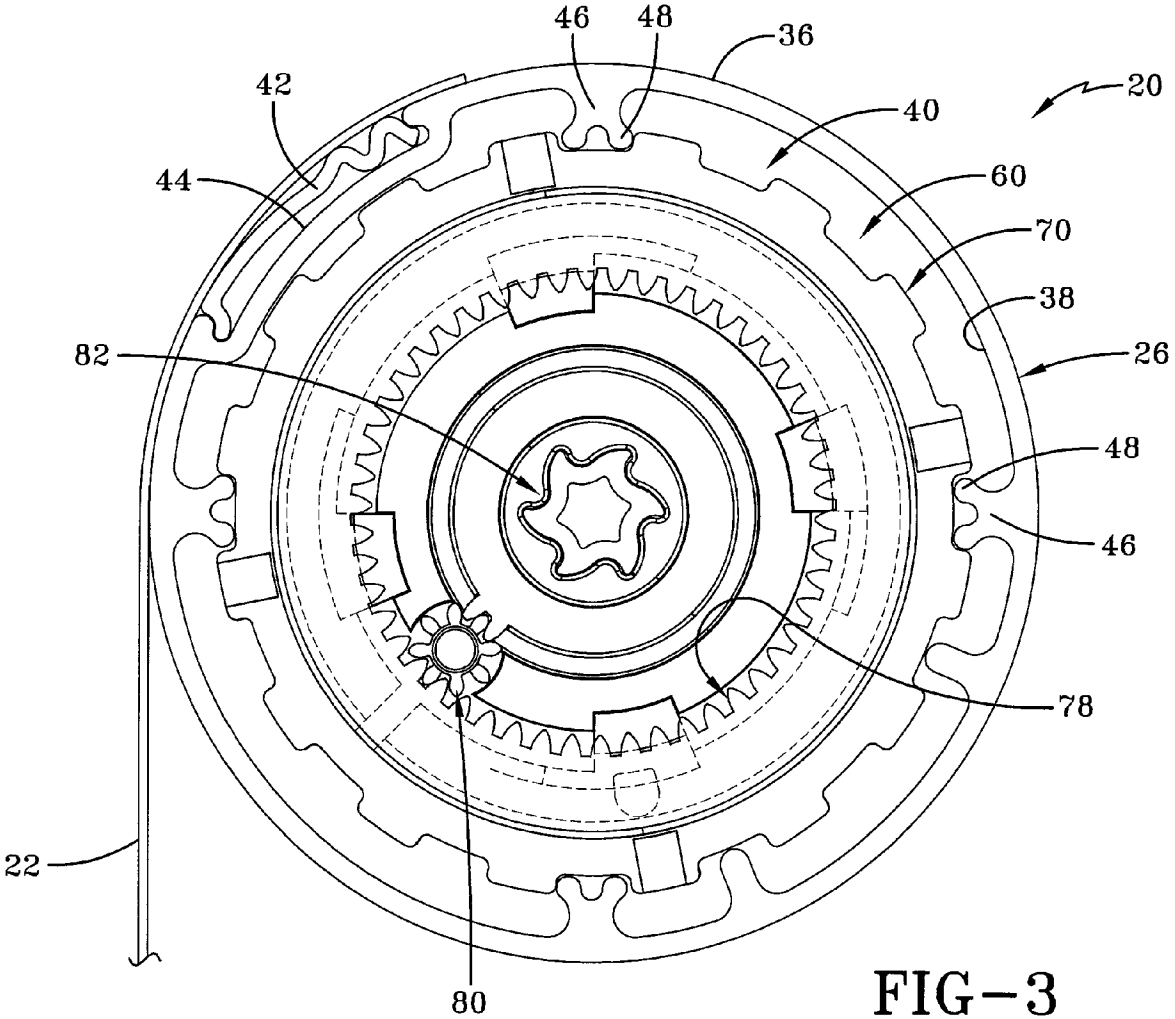
FIG. 3 is an end view of the shade drive assembly showing internal components of a gear tensioner made in accordance with the concepts of the present invention.

Referring now to FIGS. 2 and 3, it can be seen that the storage roll 26 is of a tubular construction. The roll 26 has an exterior surface 36 and an interior surface 38 which forms a hollow interior 40. As best seen in FIG. 3, the exterior surface 36 provides for an outer channel 42 which receives a shade clip 44 that is attached to a surface of the shade covering 22 so as to provide for a secure attachment between the storage roll 26 and the covering 22. The interior surface 38 includes a plurality of inner tabs 46 which extend radially inwardly. Each tab 46 provides semi-rigid tab ends 48 which collectively form a storage roll inner diameter.

A shade drive assembly, which is designated generally by the numeral 54 is received within the hollow interior 40. The shade drive assembly 54 includes a bearing housing 56 which rotatably supports the shafts 28. FIG. 2 only shows one bearing housing 56, but it will be appreciated that a similar bearing housing is located at the opposite end of the drive assembly 54. Positioned adjacent to the bearing housing 56 is a gear tensioner designated generally by the numeral 60. Axially disposed next to the gear tensioner 60 is a counterbalance assembly 62 which carries a counterbalance spring 64 inside the counterbalance assembly 62. As is well understood in the art, the counterbalance assembly 62 assists in moving the covering 22 from an open position to a closed position so as to minimize the power or force required to move the covering between positions. Positioned axially adjacent the counterbalance assembly 62 is a dampener assembly 66 which controls the speed of the shade movement. Although not shown, the shade drive assembly 54 may further include a motor and an appropriate power source, such as a battery or batteries, so as to facilitate movement of the shade covering between positions.

Referring now to FIGS. 3-9, it can be seen that the gear tensioner is designated generally by the numeral 60. The gear tensioner 60 includes a housing 70 which includes a gear holder 72 that is mateable with a housing cover 74. Maintained within the gear tensioner 60 is a ring gear 78 which is rotatably received within the gear holder 72; a pinion gear 80 which is rotatably captured by the gear holder 72 and the housing cover 74; and a spindle 82 which is rotatable within the housing 70. The gear tensioner 60 is maintained between the bearing housing 56 and the counter balance assembly 62.

Figure 4:
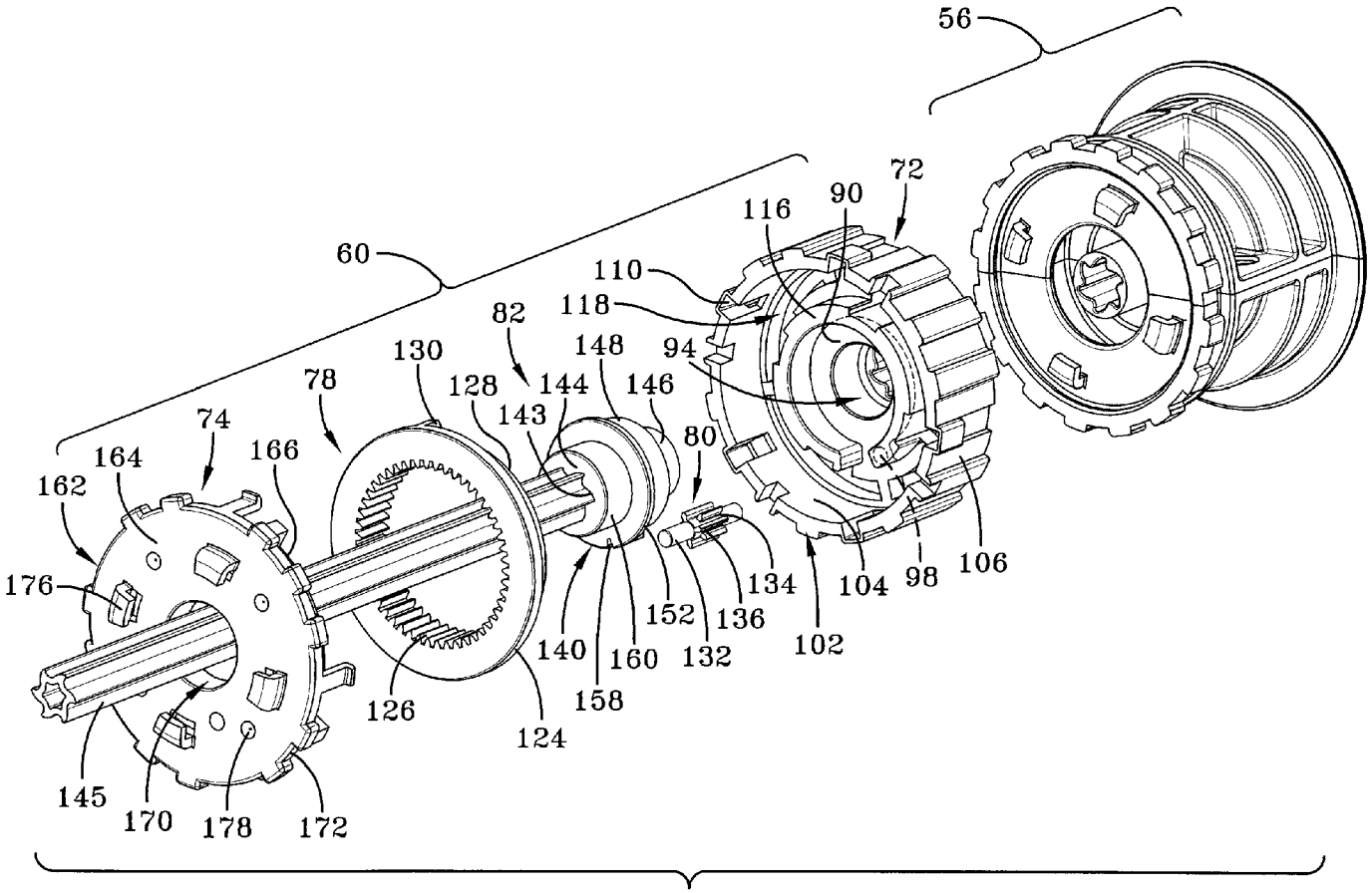
FIG. 4 is an exploded perspective view of the gear tensioner according to the concepts of the present invention.
Figure 5:
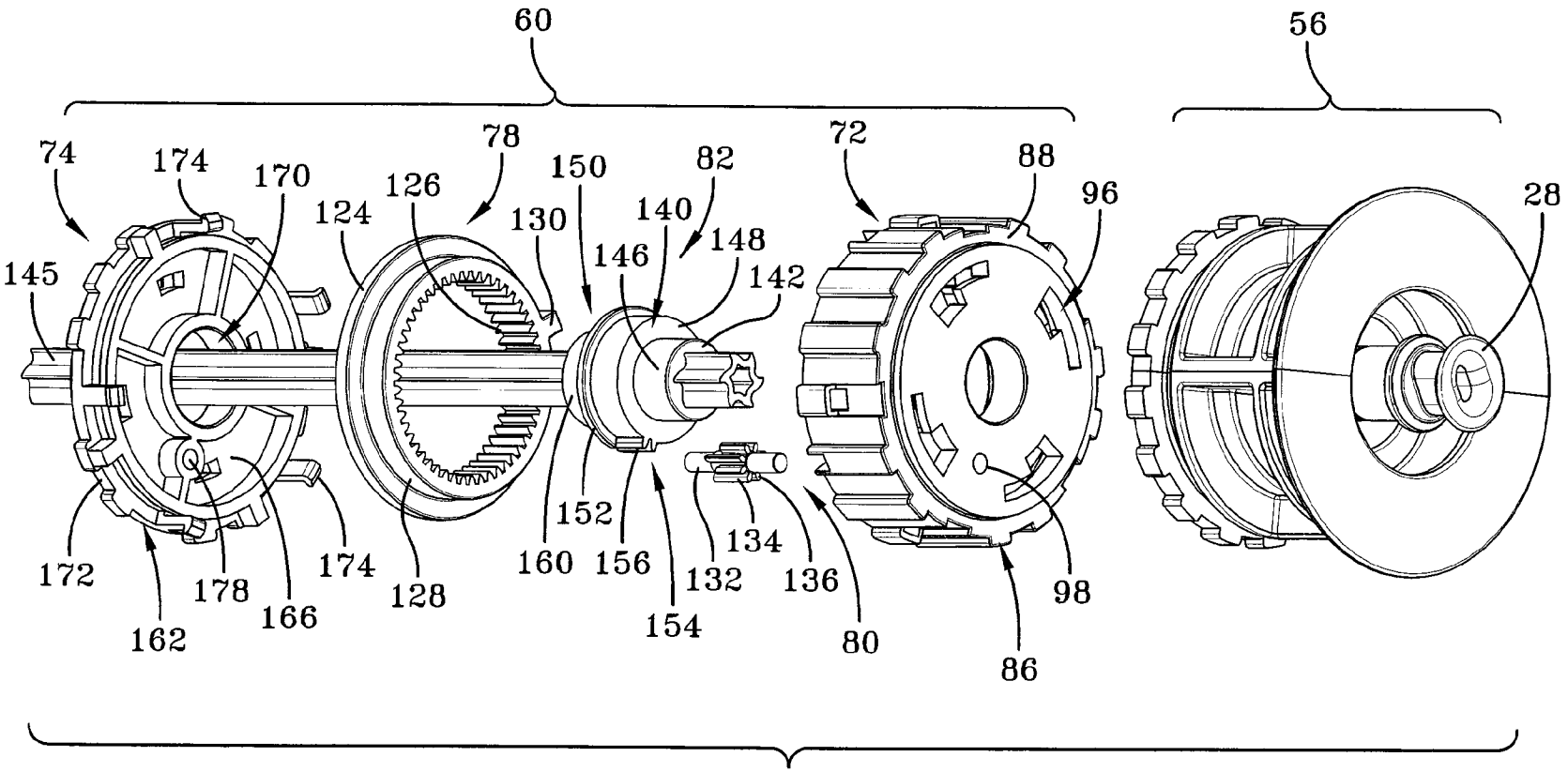
FIG. 5 is a right side perspective view of the gear tensioner.
Figure 6:
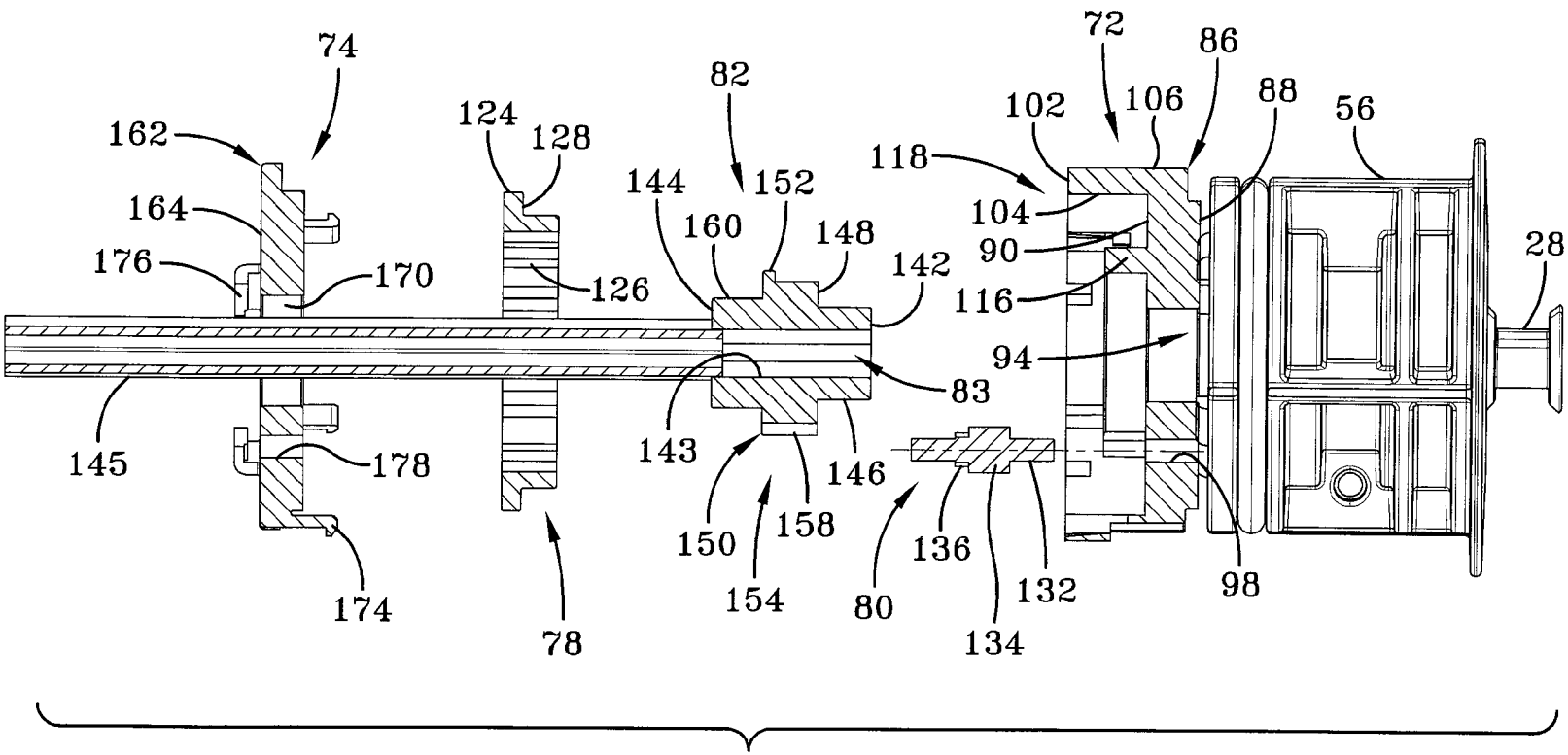
FIG. 6 is an exploded cross-sectional view of the gear tensioner.
Figure 8:
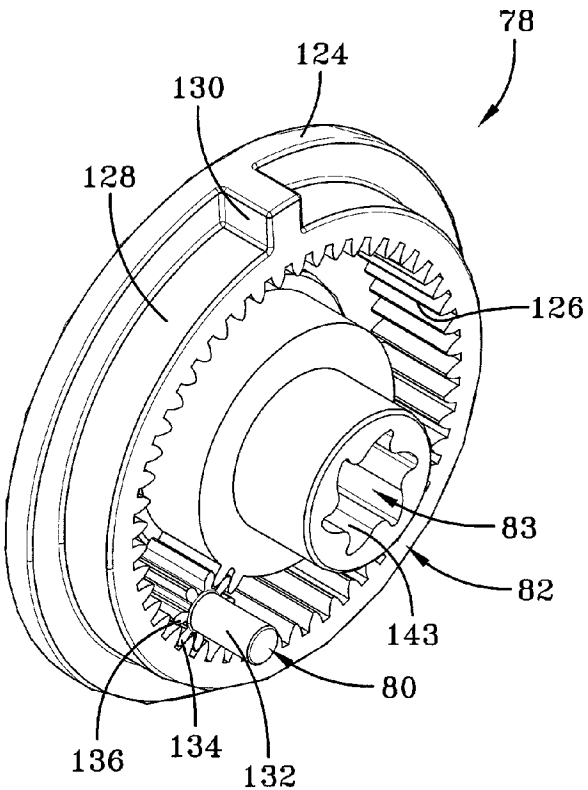
FIG. 8 is a right side perspective view of selected components of the gear tensioner according to the concepts of the present invention.

The gear holder 72 is of a substantially circular construction and provides a bearing side 86 which has an exterior surface 88 opposite an interior surface 90. The exterior surface 88 is configured so as to be adjacent the bearing housing 56 and includes structural features that allow for the tensioner to rotate with the bearing housing 56 as appropriate. The gear holder 72, and in particular the bearing side 86, includes a spindle hole 94 which rotatably receives one end of the spindle 82. A plurality of slotted openings 96 extend through the bearing side 86 and allow for coupling to the bearing housing 56 as best seen in FIGS. 4 and 5. The bearing side 86 also includes a pinion hole 98 extending therethrough so as to rotatably receive one end of the pinion gear 80.

Substantially perpendicular to the bearing side 86 is an outer housing wall 102. The housing 102 includes an interior surface 104 and a radially outward facing exterior surface 106. A plurality of lateral grooves 108 are provided on the exterior surface 106. The groves 108 receive the inner tabs 48 provided by the interior surface of the storage roll 26. Accordingly, as the storage roll rotates, the gear tensioner 60 rotates in a like direction. The outer housing wall 102 also provides for a plurality of notches 110 which are mateable with the housing cover 74 as will be described. Extending from the interior surface 90 of the bearing side 86 is an inner housing wall 116 which is of a substantially circular configuration and substantially parallel and concentric with the outer housing wall 102. Together, the inner housing wall 116 and the outer housing wall 102 form a gear groove 118. Positioned adjacent the interior surface 90 of the bearing side 86 and the outer housing wall 102 is a housing stop 120. As such, it will be appreciated that the housing stop 120 extends radially inward into the gear groove 118.

The ring gear 78 includes an outer surface 124 which is sized to be rotatably received within the gear groove 118. The ring gear 78 includes an inner toothed surface 126 which is opposite the outer surface 124. A collar 128 axially extends from the outer surface 124. A gear stop 130 extends radially outward from the collar 128 so that it is flush with the outer surface 124. When assembled, the ring gear 78 is rotatably received within the gear groove 118. However, as the ring gear 78 rotates or moves in the groove 118, the gear stop 130 stops rotational movement when it comes in contact with the housing stop 120. As such, the rotation of the ring gear 78 is somewhat less than a full 360°. In other words, the ring gear 78 is stopped from making a complete and uninterrupted rotation in either direction by the housing stop 120.

The pinion gear 80 includes opposed axle ends 132 wherein one end is rotatably received in the housing pinion hole 98 and the other end is rotatably received in a housing cover pinion hole 178. The pinion gear 80 includes a plurality of radially extending teeth which alternate between a short length tooth 134 and a long length tooth 136. In other words, the teeth 134 and 136 alternate with one another so that the long length teeth extend further along the length of the pinion gear. Both sets of teeth 134 and 136 engage and mesh with the teeth of the inner toothed surface 126 provided by the ring gear 78.

Figure 7:
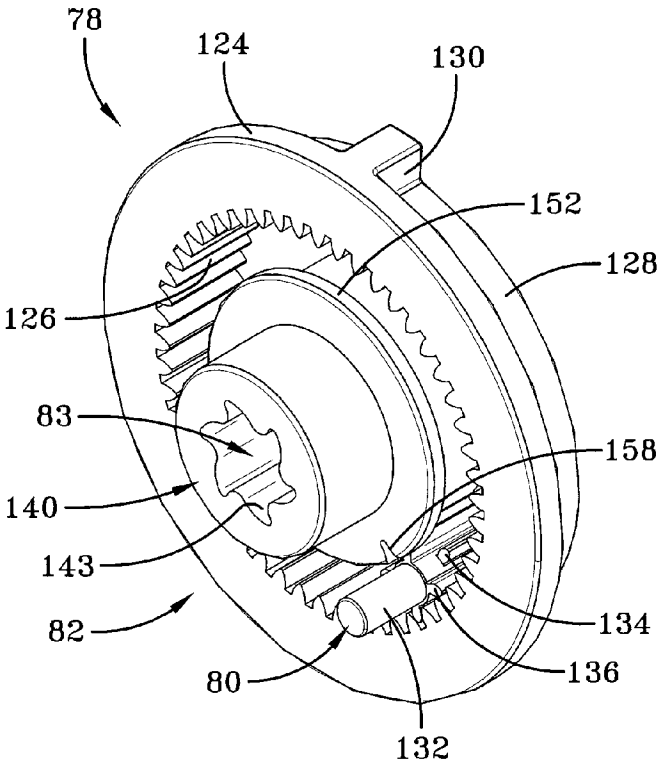
FIG. 7 is a left side perspective view of selected components of the gear tensioner according to the concepts of the present invention.
Figure 9:
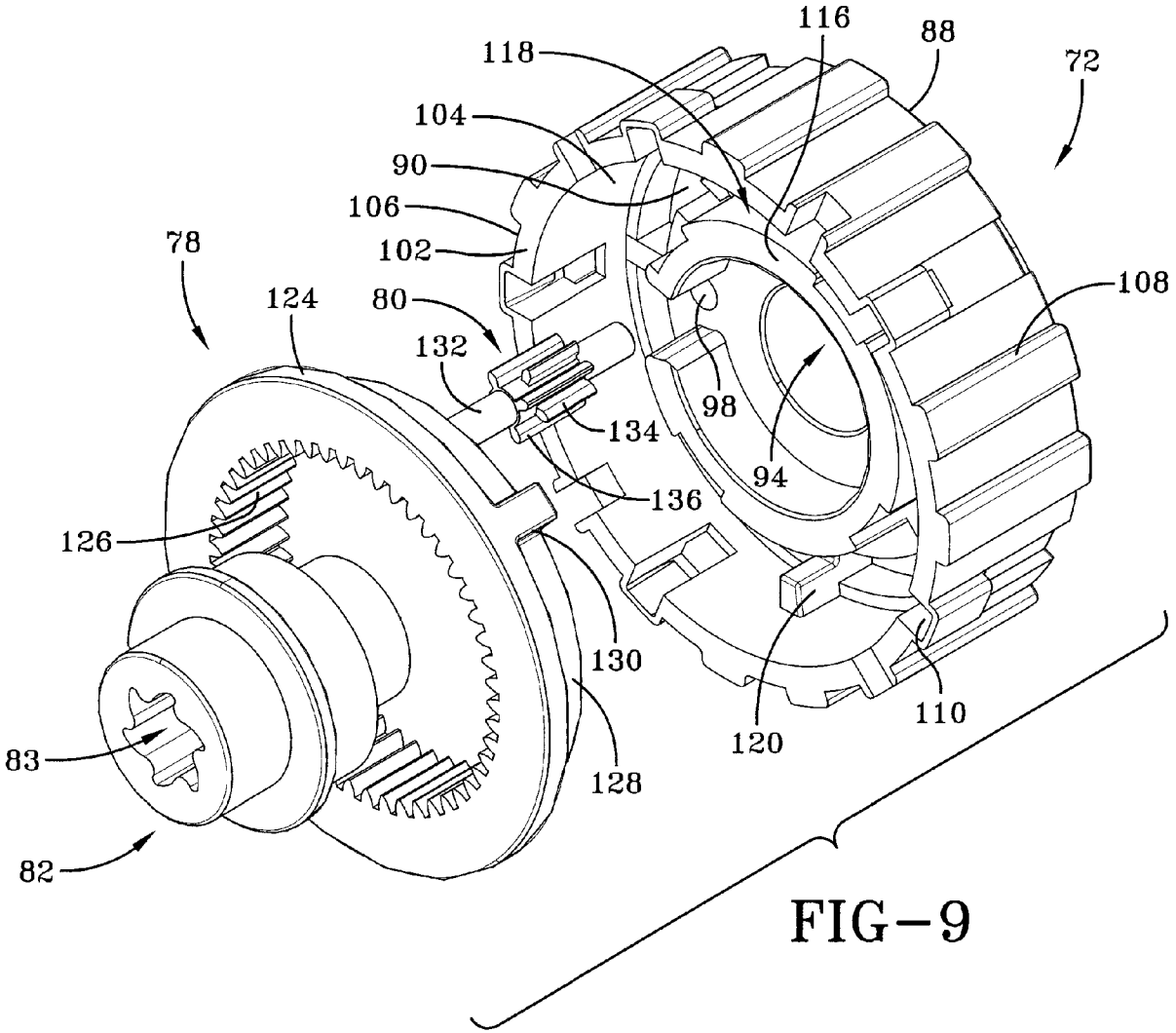
FIG. 9 is a left side perspective view of other selected components of the gear tensioner according to the concepts of the present invention.

The spindle 82 includes a body 140 which is an elongated somewhat cylindrical construction. The body provides a bearing assembly end 142 opposite a counterbalance assembly end 144. In this particular embodiment a non-circular shaft hole 143 extends axially through the body 140 so as to receive a drive shaft 145 therethrough. The bearing assembly end 142 provides a wall portion 146 that provides a bearing surface that is rotatably received in the spindle hole 94. The wall portion 146 provides a bearing surface which bears against the interior surface 90 of the gear holder 72. Disposed between the ends 142 and 144 is a gear portion 150. The gear portion 150 includes a radially extending rim 152 which fits in the space provided by the shorter teeth of the pinion gear. In other words, as best seen in FIG. 7, the thickness of the rim 152 fits in a space at the end of the short tooth 134 so that rotation of the spindle and the rim does not always result in rotation of the pinion gear 80. Extending axially along the gear portion 150 is a spindle gear tooth 154 which provides for two outer tooth surfaces 156 that form a tooth groove 158 therebetween. Whenever the gear tooth 154 engages the teeth 134,136 the pinion gear rotates incrementally, as does the ring gear. A cover wall 160, which has a diameter less than the rim 152, axially extends from the rim 152 to the counterbalance end 144 of the spindle 82.

The housing 70, as mentioned previously, includes a housing cover 74. The cover 74 includes a counterbalance side 162 which has an exterior surface 164 that is positioned adjacent the counterbalance assembly 62. The counterbalance side 162 also has an interior surface 166 that faces the components maintained within the gear holder 72. The counterbalance side or housing cover 74 has a spindle hole 170 extending therethrough that receives the counterbalance end 144 of the spindle. The outer perimeter of the counterbalance side 162 contains a plurality of lateral grooves 172 that are aligned with the lateral grooves 108 of the gear holder 72. Extending axially from the counterbalance side 162 are a plurality of deflectable tabs 174 that mate with the notches 110 of the gear holder 172. The exterior surface 164 may be provided with a plurality of external surface hooks 176 for engaging mating features of the counterbalance assembly 62. The housing cover 74 also has a pinion hole 178 extending therethrough which receives one of the axle ends 132 of the pinion gear 80.

As can be seen from the drawings, the gear tensioner includes a plurality of parts that are assembled to one another. In particular, the pinion hole 98 of the gear holder 72 receives an axle end 132 of the pinion gear 80. The pinion gear 80 is oriented such that the alternating teeth 136,136 of the gear are all adjacent to or in bearing contact with the interior surface 90 of the bearing side. As such, the gap or space between the end of the short tooth and the end of the long tooth is positioned away from the interior surface 90. The ring gear 78 is positioned within the gear groove 118 such that the internal teeth 126 are engageable with the teeth 134,136 of the pinion gear. It will further be appreciated that the stop 130 allows the ring gear to rotate almost 360°. However, the stop 130 engages and is stopped from fully rotating by the housing stop 120 maintained by the gear holder 72. The spindle is insertable through the spindle hole 94 of the gear holder 72 in such a manner that the spindle is freely rotatable therein, except when the gear stop 130 engages the housing stop 120. The spindle only incrementally rotates the pinion gear when the spindle gear tooth 154 engages the long tooth of the pinion gear. As such, a complete rotation of the spindle is required to make an incremental movement of the pinion gear. However, whenever the pinion gear is rotated, the ring gear 78 incrementally moves in the opposite direction. To complete the gear tensioner assembly, the housing cover 74 is mated with the gear cover so that the tabs 174 are mated with the corresponding notches 110. It will further be appreciated that the housing cover is aligned such that the pinion hole 178 rotatably receives the other axle end 132 of the pinion gear.

In operation, the gear tensioner is received within the storage roll 25 such that the lateral grooves are engaged by the tabs 48. Accordingly, the gear tensioner 60 rotates as the storage roll 26 rotates, but the spindle does not. By utilizing the rotatable nature of the assembled gear tensioner 60 with respect to the spindle, it will be appreciated that a pre-tension can be applied to the spring or springs maintained in the counterbalance assembly. Skilled artisans will appreciate that the gear tensioner can be initially provided with the stops engaging one another and then the gear tensioner can be engaged to the counterbalance assembly so as to pre-tension the springs contained therein. In this embodiment, one end of the counterbalance spring 64 is fixed at one end so that the spring does not rotate with normal operation of the curtain. This is accomplished by connecting one end of the non-circular shaft 145 to a spring perch on one end of the counterbalance spring and the other end of the shaft 145 is connected to the bracket 32 which is attached to the supporting structure. The pre-tensioning is provided by rotating the gear tensioner with respect to spindle 82 and the received shaft 145 a selected number of turns and then installing both the counterbalance assembly and the gear tensioner into the storage roll tube. This pre-tensioning ensures that the counterbalance springs maintained within the counterbalance assembly assist with the movement of the shade covering as it is raised or lowered.

In the present embodiment the support shaft extends through the spindle so as to allow for connection between bearing housing support shaft 28 and counterbalance spring (s) 64. In other words, the support shaft 28 is fixed from rotation and extends through the bearing housing 56 mating with the drive shaft 145 carrying the spindle 82. The drive shaft 145 is also rotatably attached to the counterbalance assembly 62.

As such, by providing more tension with the gear tensioner, more force is required to raise and lower the shade. Accordingly, more tension with the gear tensioner results in less motor force to raise the shade, but more force to lower the shade. However, if desired, less tension can be provided so that less force is required to lower the shade, but more motor force is required to raise the shade. By utilizing such a feature of the gear tension, a balance of equal force for both raising and lowering a shade and less motor power is required. As a result, a smaller motor can be used, thus facilitating longer battery life.

Figure 10:
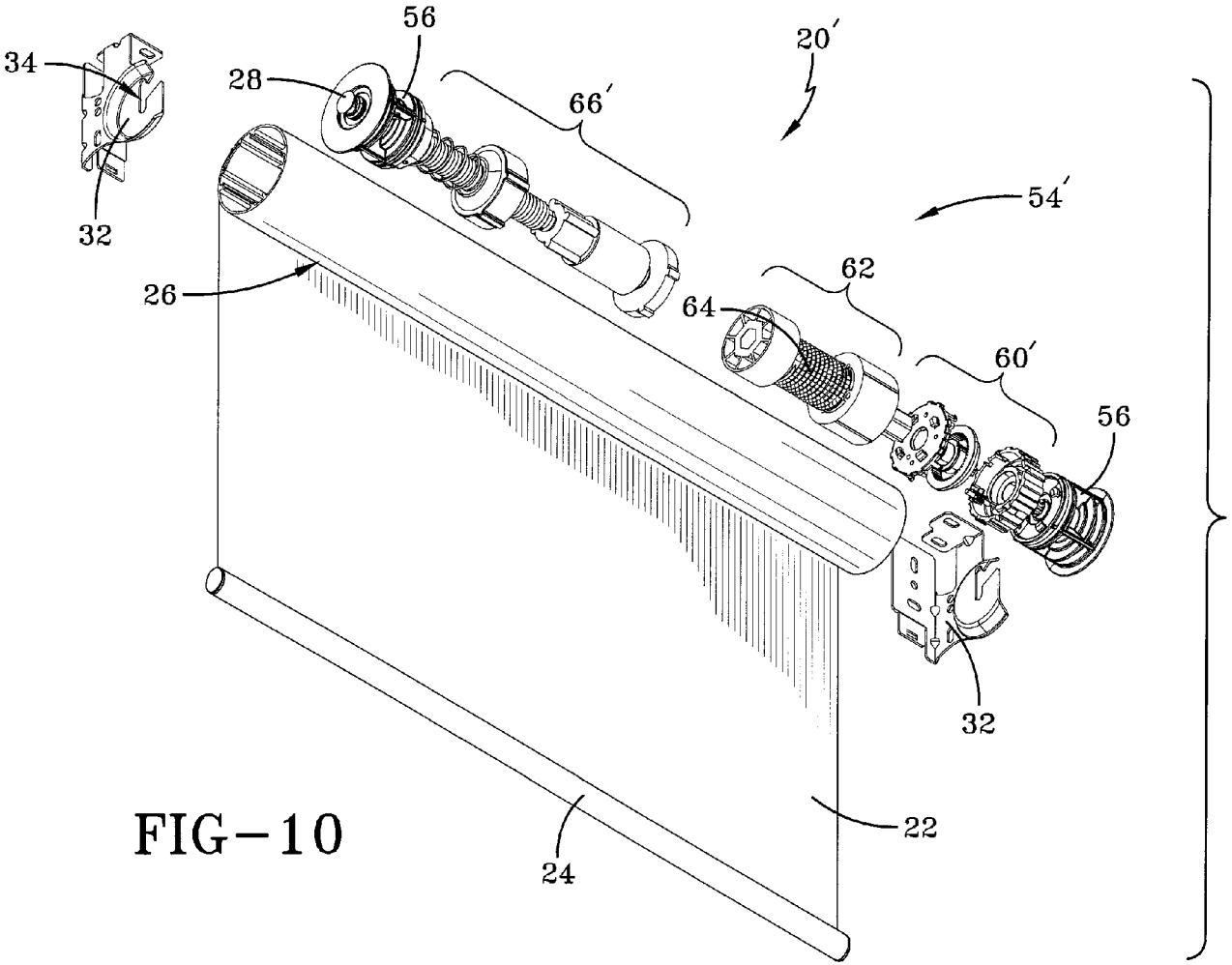
FIG. 10 is a perspective view showing an alternative shade drive assembly maintained within the roller shade assembly according to the concepts of the present invention.
Figure 12:
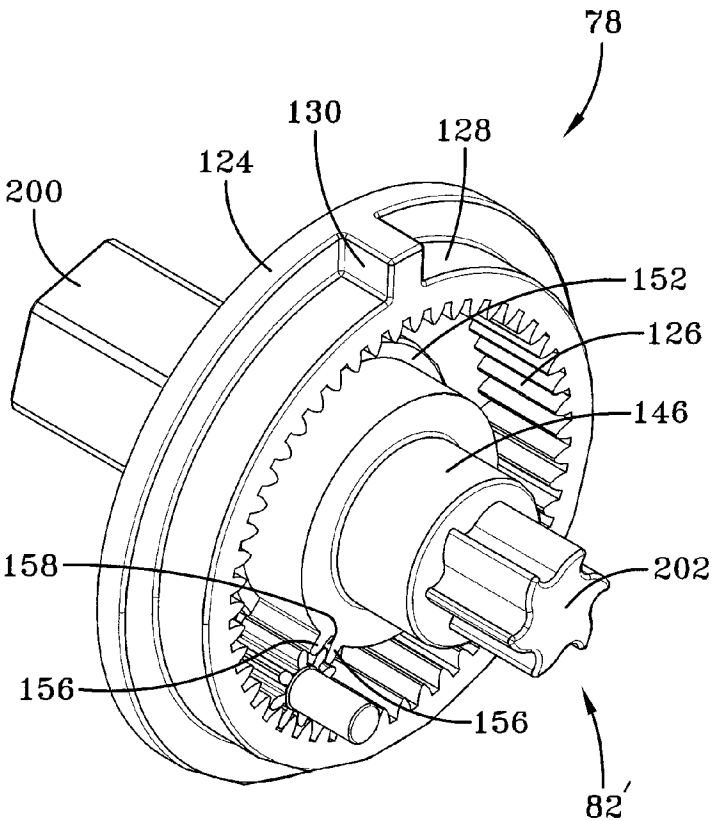
FIG. 12 is a right side perspective view of selected components of the alternative gear tensioner according to the concepts of the present invention.
Figure 11:
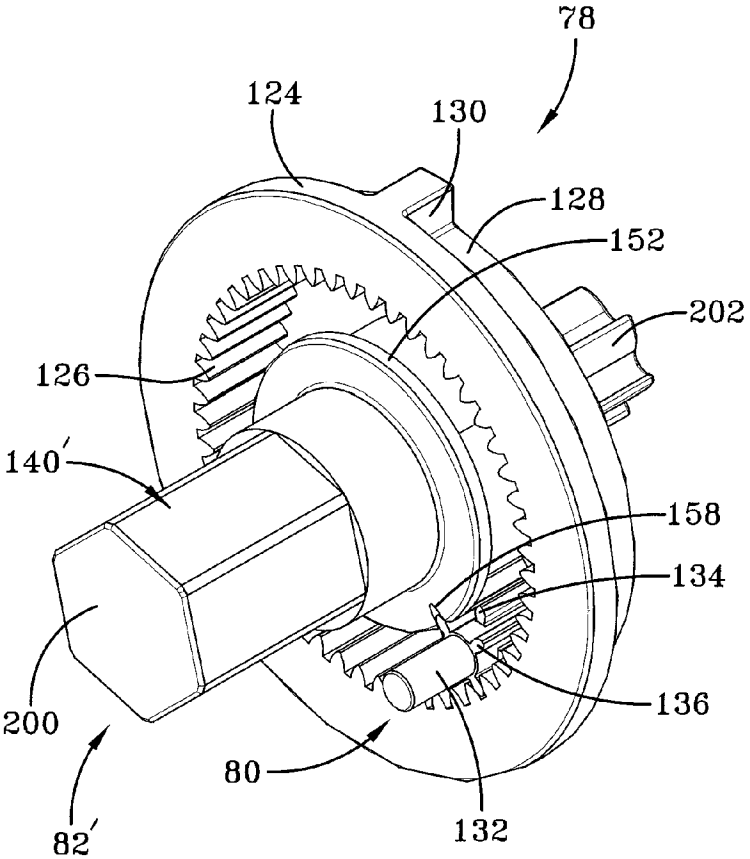
FIG. 11 is a left side perspective view of selected components of the alternative gear tensioner according to the concepts of the present invention.

Referring now to FIGS. 10-12, it can be seen that an alternative roller shade assembly is designated generally by the numeral 20'. Those components which are the same are identified with the same number. Those components which are somewhat similar are identified with the same number and a prime (') designation. This configuration is for torsional counterbalance systems and is substantially the same as the previous embodiment described, however instead of utilizing a drive shaft extending through the spindle to a flat type counterbalance spring, the spindle is provided with non-circular ends so as to allow for a driving force from the torsional springs in the counterbalance assembly to be transmitted therethrough.

As best seen in FIG. 10, a roller shade assembly 20' includes a gear tensioner 60' positioned axially adjacent one side of the bearing housing 56. And, as in the other embodiment, a counterbalance assembly 62, and a dampener 66 or a motor assembly are axially positioned adjacent one another in a shade drive assembly 54'.

As best seen in FIGS. 11 and 12, the gear tensioner 60' is substantially the same as the gear tensioner 60 in the previously described embodiment. One end of the spindle 82' is provided with a hex end 200 while the opposite end is provided with a star end 202. The hex end mates with the counterbalance assembly 62 so as to allow for transfer of the tensioning force between the gear tensioner and the counterbalance spring 64. The star end is mateable with the bearing assembly 56. Accordingly, the gear tensioner 60' rotates with the storage roll 26 until such time that the stops 130 and 120 engage or come in contact with one another.

In this embodiment, one end of the counterbalance spring must be attached to the structure such that it does not rotate in normal operation of the curtain. And in this embodiment the spindle 82' has the hex end 200 attached to a spring perch on one end of the counterbalance spring and the star end 202 attached to the support shaft 28 which is attached to the supporting structure through the bracket 32. In particular, the star end 202 is coupled to the support shaft 28 and is stationary. This is similar to the drive shaft 145 being coupled to the shaft 28 in the first embodiment. In other words, in the first embodiment the spindle 82 is a pass-through for the drive shaft 145 to bearing housing support shaft 28. In the second embodiment, the spindle 82' is an adaptor between the bearing housing support shaft 28 and an appropriate driving force generated by the torsion counterbalance assembly 66'. By engaging the stops with one another, the counterbalance spring is pre-tensioned against the stops. As such, when the storage roll 26 begins to deploy the covering 22, the stops move away from one another. This functions the same as the first embodiment except with a different type of spring system.

Based on the foregoing, the advantages of the present invention are readily apparent. The gear tensioner allows for the shade or blind to be shipped and installed with a pre-tension already provided on the counterbalance springs. This avoids having the installer, and/or the end user, attempting to provide a pre-tension to the counterbalance springs and operation of the shade. Use of the gear tensioner does allow for the tension of the counterbalance springs to be adjusted after installation by a skilled technician. This configuration of the gear tensioner is advantageous in that it induces less parasitic drag into the counterbalance system than a conventional gear train. Additionally, the disclosed gear tensioner can be pre-charged with tension in such a way as to be safe for the end user to handle without the potential of the tension being accidentally released.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

What is claimed is:

1. A movable assembly having a counterbalance gear tensioner, comprising:

a covering;

a rotatable storage roll that carries said covering, said storage roll having a hollow interior;

a counterbalance assembly received in said hollow interior, wherein said counterbalance assembly assists in movement of said covering; and a gear tensioner received in said hollow interior and rotatable with said rotatable storage roll, and coupled to said counterbalance assembly, said gear tensioner adjusting a tension force of said counterbalance assembly, said gear tensioner comprising a housing, wherein said housing comprises a housing stop;

a ring gear rotatably received in said housing, said ring gear including a gear stop that is engageable with said housing stop after said housing has rotated a predetermined number of times;

a pinion gear rotatably supported by said housing and engaging said ring gear; and a spindle rotatably received in and extending from said housing, one end of said spindle coupled to said counterbalance assembly, said spindle having a single spindle gear tooth engageable with said pinion gear, wherein a full rotation of said housing with respect to said spindle results in only incremental rotation of said ring gear and said pinion gear, wherein said pinion gear has a plurality of pinion teeth with grooves therebetween, said plurality of pinion teeth alternating between short teeth and long teeth, said ring gear having a plurality of inner teeth with grooves therebetween that engage said short teeth and said long teeth, and said at least one spindle gear tooth having a tooth groove that engages only one of said plurality of long teeth and bypasses said plurality of short teeth on each complete rotation of said spindle.

2. The assembly according to claim 1, wherein said gear tensioner comprises:

a housing; and a spindle rotatably received in and extending from said housing, wherein one end of said spindle is coupled to said counterbalance assembly, and wherein rotation of said housing with respect to said spindle prior to coupling with said counterbalance assembly sets the tension force of said counterbalance assembly when coupled to said gear tensioner.

3. The assembly according to claim 1, wherein said spindle includes a radially extending rim that fits in a space at an end of said short teeth as said spindle rotates unless one of said short teeth is engaged by said spindle gear tooth.

4. The assembly according to claim 1, wherein said housing comprises:

a gear holder; and a housing cover mateable with said gear holder so as to rotatably retain said ring gear, said pinion gear and said spindle.

5. The assembly according to claim 4, wherein each end of said spindle has a drive shaft extending therethrough, wherein one end of said shaft engages said counterbalance assembly.

6. The assembly according to claim 4, wherein said spindle has opposed non-circular ends, wherein one end engages said counterbalance assembly and an opposite end engages a bearing housing.

7. The assembly according to claim 1, wherein a complete rotation of said housing with respect to said spindle incrementally adjusts tension force in said counterbalance assembly.

8. The assembly according to claim 7, wherein said housing includes a housing stop and said ring gear includes a gear stop that is engageable with said housing stop after said housing has rotated a predetermined number of times.

9. The assembly according to claim 8, wherein said housing has a plurality of axially extending hooks that engage said counterbalance assembly.

* * * * *